United States Patent [19]

Pitschi et al.

[11] Patent Number: 4,829,271

[45] Date of Patent: May 9, 1989

[54] COAXIAL RF SWITCH MATRIX

[75] Inventors: Franz-Xaver Pitschi, Rottach/Egern; Georg Spinner, Feldkirchen-Westerham, both of Fed. Rep. of Germany

[73] Assignee: Spinner GmbH, Elektrotechnische Fabrik, Munich, Fed. Rep. of Germany

[21] Appl. No.: 118,658

[22] Filed: Nov. 9, 1987

[30] Foreign Application Priority Data

Nov. 11, 1986 [DE] Fed. Rep. of Germany ..... 3638392

[51] Int. Cl.[4] ..... H01H 19/00; H01H 63/33

[52] U.S. Cl. ..... 333/105; 333/106; 333/107; 333/262; 200/504

[58] Field of Search ..... 333/101, 103–107, 333/262; 340/825.79; 379/248, 291, 292, 306; 200/153 S

[56] References Cited

U.S. PATENT DOCUMENTS

| | | | |
|---|---|---|---|
| 3,009,118 | 11/1961 | Stinson | 333/105 |
| 3,211,847 | 10/1965 | Johnson | 200/153 S X |
| 3,215,954 | 11/1965 | Stevens | 333/105 |
| 3,223,812 | 12/1965 | Wright et al. | 333/262 X |
| 3,260,967 | 7/1966 | McCalflin et al. | 333/105 |
| 3,270,299 | 8/1966 | Stapf | 200/153 S X |
| 3,331,991 | 7/1967 | Carlisle et al. | 333/101 X |
| 3,717,736 | 2/1973 | Kershner et al. | 200/153 S |
| 3,873,794 | 3/1975 | Owen | 200/153 S |

FOREIGN PATENT DOCUMENTS

| | | | |
|---|---|---|---|
| 2025736 | 1/1980 | United Kingdom | 340/825.79 |

*Primary Examiner*—Eugene R. Laroche
*Assistant Examiner*—Benny Lee
*Attorney, Agent, or Firm*—Henry M. Feiereisen

[57] ABSTRACT

An antenna matrix switch bay includes a housing which is subdivided in a plurality of chambers defining a matrix configuration of coaxial transmitter switches and coaxial antenna switches provided with opposing fixed contacts in row direction and column direction. Each chamber of the housing contains one single switch whereby one transmitter switch and one antenna switch define a node and have a common switch drive shaft perpendicular to both planes. The switch drive includes a straight switch member in each plane and a double-cranked switch member insulated from the switch members and connecting the fixed contacts of one plane with those of the other plane.

15 Claims, 4 Drawing Sheets

COAXIAL RF SWITCH MATRIX

BACKGROUND OF THE INVENTION

The present invention is concerned with an antenna matrix switch bay, and in particular to such an antenna matrix switch bay which is of matrix configuration and comprises a plurality of coaxial transmitter switches arranged in rows and coaxial antenna switches arranged in columns to allow a random connection of transmitters with antennas.

It is known to provide antenna matrix switch bays either in single node structure or in matrix configuration. In the latter case, several transmitter switches are arranged in rows and several antenna switches are spaced from each other in columns so as to define a number of nodes wherein one antenna switch and one transmitter switch define one node and have a common switch drive shaft which controls the making and breaking of circuits via cooperating fixed and movable contacts. Each switch drive shaft supports the movable contacts which include a straight switch member for the antenna switch and the transmitter switch with these switch members offset to each other by 90° and further supports a double cranked switch member whose cranked ends are offset to each other and to the straight switch members by 90°.

Each switch with its pertaining fixed and movable contacts as well as the drives is contained in a sheet metal housing. Thus, depending on the numer of switches, a plurality of such housings is arranged in rows and columns and attached to each other. The connection between node to node is obtained by short coaxial line stubs. Such connections require at least two support insulators as well as two inner conductor contacts and two outer conductor contacts thus resulting in a complicated and cumbersome production and assembly of such an antenna matrix switch bay. Further, the replacement of individual nodes is very complicated since all four line connections must be detached and the sheet metal construction has to be disassembled at least in part.

A further drawback of known antenna matrix switch bay is the considerable and unevenly distributed heat expansions of the matrix switch bay at high RF powers. Taking into account the frequent use of matrix switch bays of considerable dimensions, special adaptors like e.g. metal bellows must be used and thus causing further expenditures and additional attenuation.

Moreover, known matrix switch bay are neither dust-proof nor pressure-proof and thus cannot be operated at overpressure or underpressure. This, however, is desired in order to increase the electric strength.

SUMMARY OF THE INVENTION

It is an object of the present invention to provide an improved antenna matrix switch bay obviating the afore-stated drawbacks.

This object and others which will become apparent hereinafter are attained in accordanced with the present invention by accommodating all switches in a common one-piece housing which includes a plurality of chambers for individually housing the switches.

Through the provision of one single housing for all switches and accommodating them individually in the chambers, the production of such matrix switch bays to considerably facilitated because there is no necessity to make numerous sheet metal parts with their required connection via screws or welding. The use of one housing, preferably a cast housing leads to a more uniform heat distribution so that a uniform and especially small heat expansion is obtained. Moveover, the antenna matrix switch bay according to the invention is compact which means that the heat expansion is considerably reduced also in absolute terms in comparison to known antenna matrix switch bays with the same number of nodes. In addition, the use of connecting line stubs from node to node is avoided thus considerably reducing the number of necessary parts and attaining a reduced transmission loss.

In accordance with another feature of the invention, the connection of the outer conductors is obtained through the housing while the connection of the inner conductors is provided through opposing fixed contacts whereby adjacent fixed contacts of adjoining nodes are made of one piece unit and suitably placed on one common support insulator when extending in the same plane.

According to yet another feauture of the invention, the cross-talk attenuation can be kept to a minimum by providing each transmitter switch and antenna switch with opposing fixed short-circuit contacts which are arranged offset by 90° to the opposing fixed contacts. Advantageously, the housing is pressure-proof to increase the electric strength and the admissible RF-power.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
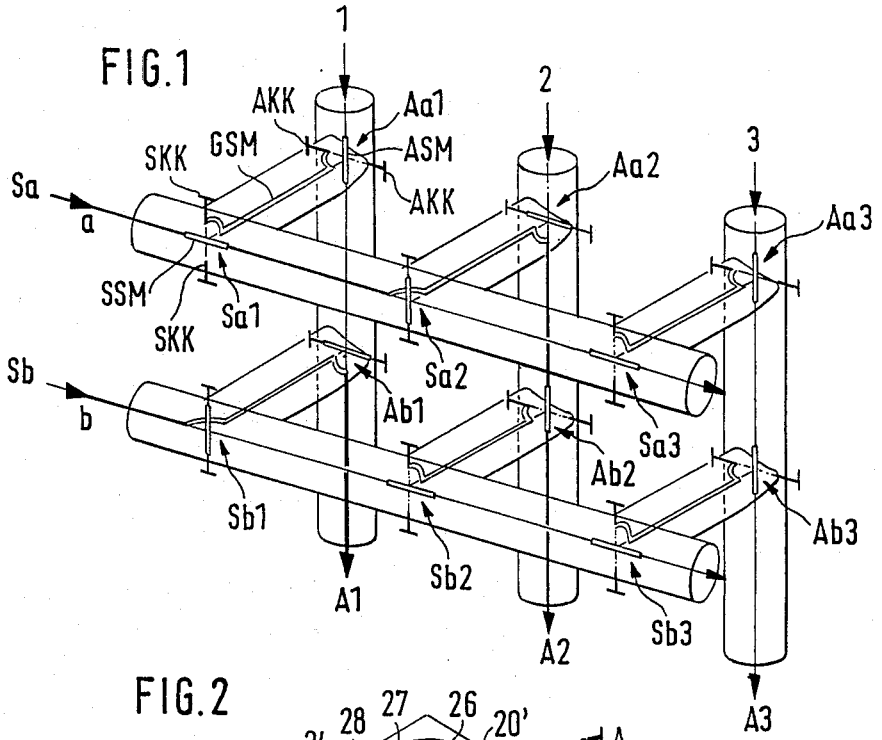
FIG. 1 is a perspective RF-circuit diagram in accordance with the present invention.

Referring firstly to FIG. 1, there is shown a schematic circuit diagram of an antenna matrix switch bay in accordance with the invention for selectively connecting transmitters and antennas. In the nonlimiting example of FIG. 1, the matrix switch bay is illustrated in form of a matrix with three times two branch points or nodes for allowing the random connection between two transmitters Sa, Sb and three antennas A1, A2 and A3.

In a same first plane, the matrix switch bay includes three coaxial transmitter switches Sa1, Sa2, Sa3 in a first row and three coaxial transmitter switches Sb1, Sb2, Sb3 in a second subjacent row. Behind the first plane, the matrix switch bay further includes in a second plane two coaxial antenna switches Aa1, Ab1 in a first column, two coaxial antenna switches Aa2, Ab2 in a second column and two coaxial antenna switches Aa3, Ab3 in a third column to complete the matrix with two times three nodes wherein one transmitter switch and one antenna switch define one node as for example the transmitter switch Sa1 and the antenna switch Aa1. The selective connection through each node as defined by one transmitter Sa, Sb and one antenna A1, A2, A3 is obtained by switching the inner conductors by means of a common switch drive shaft which extends perpendicular to the first and second planes but for ease of illustration is not shown in FIG. 1.

Each switch drive shaft supports in the transmitter (or first) plane a straight switch member SSM in form of a transmitter switch blade and in the antenna (or second) plane a straight switch member ASM in form of an antenna switch blade which is turned by 90° relative to the switch member SSM. In addition, each switch drive shaft supports a double cranked switch member GSM (cranked switch blade), the cranked contacting ends of which are offset to each other as well as relative to the straight switch members SSM, ASM of the pertaining plane by 90° as shown in FIG. 1.

In the switch position as illustrated in FIG. 1, the antenna matrix switch bay is controlled in such a manner that the transmitter Sa in the first row is connected to the antenna A2 through the second node and the transmitter Sb in the second row is connected to the antenna A1 through the first node via the respective cranked switch members GSM.

In order to increase the cross-talk attenuation, the transmitter switches are provided with opposing fixed shorting contacts SKK (shorting transmitter contacts) and the antenna switches have opposing fixed shorting contacts AKK (shorting antenna contacts). These fixed contacts SKK, AKK connect those cranked switch members GSM to ground potential i.e. with the outer conductor, when the respective node is not through-connected, and connect those straight switch members SSM, ASM of the transmitter switch and antenna switch at through-connected node to ground potential i.e. with the outer conductor.

Figure 2:
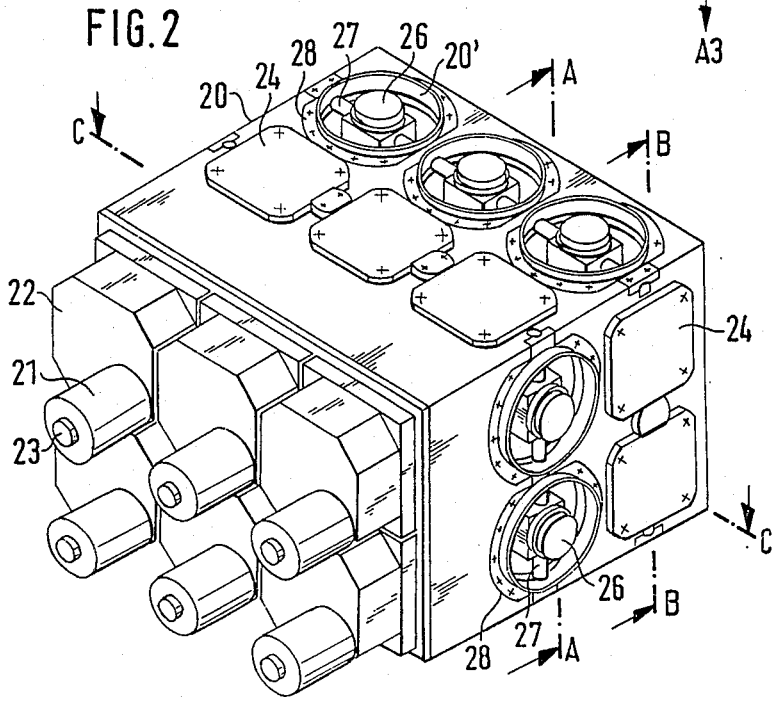
FIG. 2 is a perspective illustration of one embodiment of an antenna matrix switch bay according to the invention.

Turning now to FIG. 2 which shows a perspective illustration of an antenna matrix switch bay according to the invention, it can be seen that all switches of the matrix as illustrated in FIG. 1 are contained in a common case housing 20. The housing 20 is provided with cutouts 20' in row direction as well as in column direction for allowing coaxial connections of the transmitters Sa, Sb and antennas A1, A2, A3. Each coaxial connection comprises a terminal 26 for an inner conductor and an outer conductor flange 28. The inner conductor terminals 26 which are aligned in one plane in row direction or column direction are placed on a common support insulator 27. The outer shorting contacts AKK, SKK are covered toward the outside by flange plates 24 which are attached to the housing 20 by suitable means like e.g. screws.

The switch drive shafts which are not visible in FIG. 2 define with the movable contacts SSM, GSM, ASM the switch rotor and is rotated by means of suitable drives flanged at the outside to the housing 20. In the present nonlimiting example, the drive for each switch drive shaft comprises an electromotor and a gear transmission 22. In order to allow a manual operation in case of emergency, the motor shafts project beyond the electromotor 21 and are provided with a turning knob 23 at their exposed end.

Figure 6:
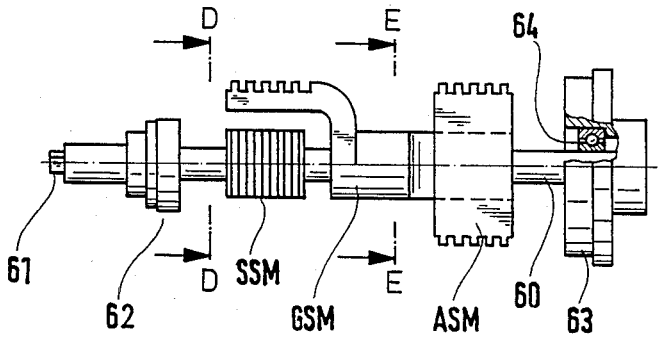
FIG. 6 is a side view of a switch rotor according to the invention.
Figure 7:
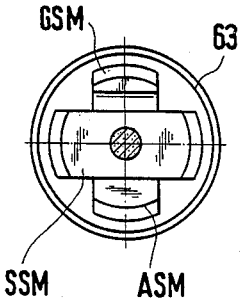
FIG. 7 is a cross sectional view of the switch rotor taken along the line D—D in FIG. 6.
Figure 8:
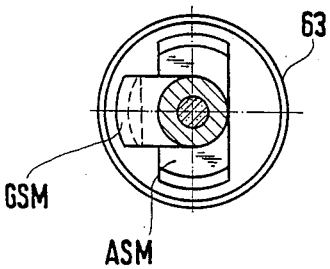
FIG.8 is a cross sectional view of the switch rotor taken along the line E—E in FIG. 6.

Turning now in particular to FIGS. 6 to 8 which illustrate in more detail the structure of the switch rotor, it can be seen that the switch rotor includes e.g. an insulating drive shaft 60 provided at one end thereof with a square stub 61 via which the rotation of the shaft 60 is attained. At a distance to the stub 61 along a front section, the drive shaft 60 is supported by a bearing 62 while its other end is provided with a bearing cap 63 accommodating a rolling-contact bearing 64 and having a diameter which is greater than the radial length of the movable switch members SSM, GSM, ASM. Supported by the switch drive shaft 60 between the front bearing 62 and the rear bearing cap 63 is the transmitter switch member SSM, the cranked switch member GSM and the antenna switch member ASM with the switch member GSM insulated from the switch members SSM and ASM and providing the connection between the transmitter plane and the antenna plane upon through-connected node.

Figure 3:
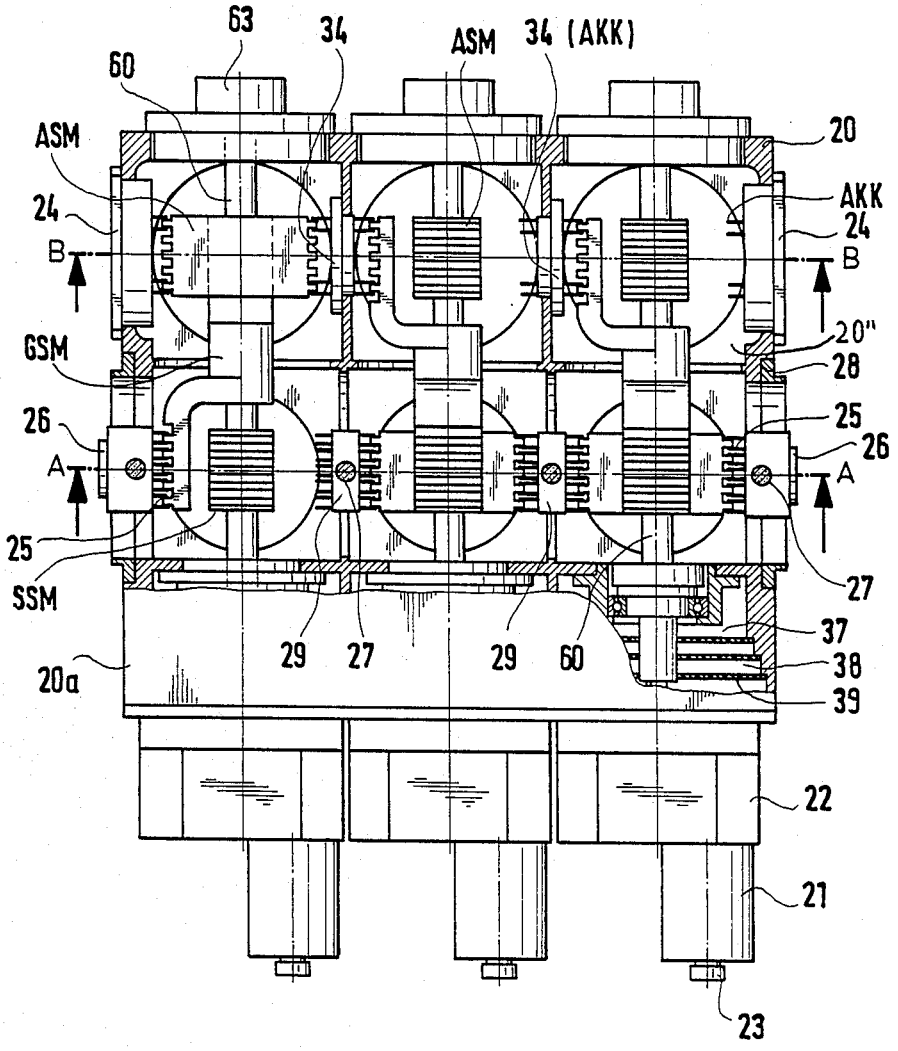
FIG. 3 is a cross sectional view of the matrix switch bay taken along the line C—C in FIG. 2.
Figure 4:
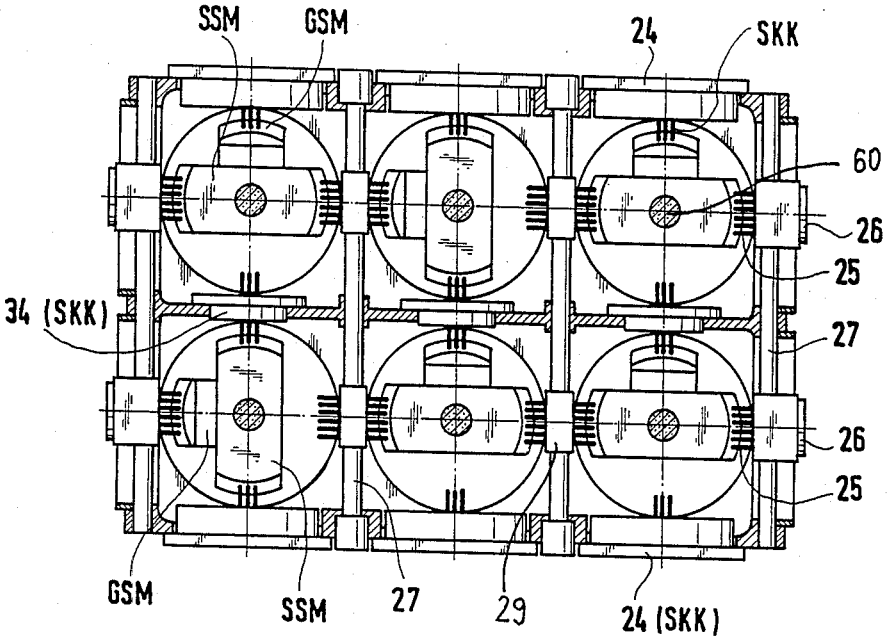
FIG. 4 is a cross sectional view of the matrix switch bay taken along the line A—A in FIG. 2.
Figure 5:
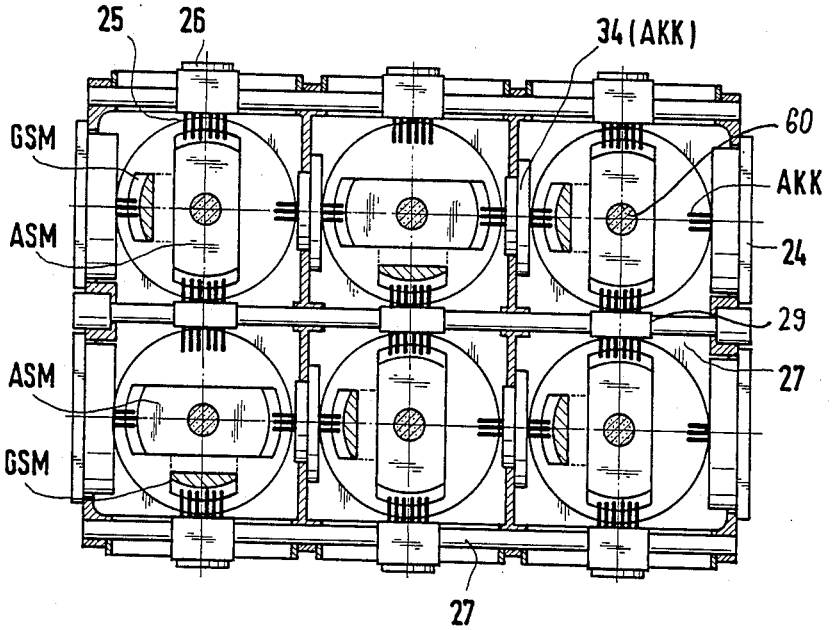
FIG. 5 is a cross sectional view of the matrix switch bay taken along the line B—B in FIG. 2.

Turning now to FIGS. 3-5 it can be seen that the housing 20 is subdivided into a plurality of chambers or compartments 20", each of which accommodating one switch i.e. a transmitter switch or an antenna switch. The shorting contacts SSK, AKK which are externally arranged are integrally connected in one piece with the pertaining end flanges 24 and thus are conductingly connected with the housing 20. The internal shorting contacts which are designated by reference numeral 34 are located between adjoining chambers 20" in such a manner that adjacent shorting contacts 34 are designed in one-piece.

As can be seen in particular from FIGS. 4 and 5, the matrix switch bay is further provided for each transmitter switch and antenna switch with outer fixed contacts 25 which are offset by 90° to the shorting contacts SKK, AKK and are integrally connected to the inner conductor terminals 26. In addition, fixed contacts 29 are arranged between adjoining chamber 20" such that adjacent fixed contacts 29 are made of one piece.

FIG. 4 which shows the transmitter plane in cross sectional view depicts that those fixed contacts 25, 29 which are disposed in the same vertical plane are all supported by a common support insulator. FIG. 5 shows the antenna plane in cross sectional view and it can be seen that those fixed contacts 25, 29 which are disposed in the same horizontal plane are also all supported by a common support insulator 27.

The position of the movable contacts or switch members SSM, ASM, GSM is illustrated in more detail in FIGS. 4 and 5 which show the respective switching state as indicated in the schematic circuit diagram of FIG. 1. When selecting a connection of the transmitter Sb with the antenna A1, the switch member SSM of transmitter switch Sb1 is moved into a vertical position so as to be bear against the opposing shorting contacts SKK and 34. Likewise, the switch member ASM of antenna switch Ab1 is moved in horizontal position so as to contact the opposing shorting contacts AKK. The pertaining cranked switch member GSM is turned into a position to contact with its ends the respectively opposing fixed contacts 25. This position of these movable switch members is shown in the lower left hand chamber 20" in FIGS. 4 and 5. Thus, the node is through-connected and transmitter Sb is in communication with the antenna A1. In like manner, the movable contacts occupy the positions upon connection of transmitter Sa with antenna A2.

In the other cases in which the trasmitters are not connected with the antennas i.e. when the pertaining nodes are not through-connected, the switch members SSM and ASM extend in opposite direction and bear against the respective fixed contacts 25, 29 as shown in FIGS. 4 and 5. The cranked switch members GSM, on the other hand, now lie against the shorting contacts SKK and AKK, respectively.

Referring now again to FIG. 3, the housing 20 is additionally provided with a space 20a located in front of the transmitter plane (i.e. in FIG. 3 below the transmitter plane). Accommodated in the space 20a are three flat bars 37, 38, 39 in form of e.g. printed circuit boards arranged in planes parallel to each other and connected to the housing 20. These printed boards 37, 38, 39 can be used for a variety of purposes that is for providing the current supply e.g. for the drive motors 21 of all nodes for instance through printed board 37, and signalling of the switching states of the nodes for example through printed board 38. In the latter case, the switch drive shafts 60 are provided with suitable cams which actuate contacts on the pertaining board. In addition, one of the boards e.g. board 39 carries the tracks and the switches and switch contacts for guiding the carrier safety loop.

Each printed board 37, 38, 39 is provided with a single plug-type connector (not shown) for all external electric connections. The use of such printed boards 37, 38, 39 in an antenna matrix switch bay allows a very compact unit in which the internal cross connections do not require complicated cabling in the area of the auxiliary circuits and yet are reliable because the contacting of the cross connections as a possible source of errors is eliminated.

The gear transmissions 22 are detachably fixed to the housing 20 in order to allow their replacement without discontinuing operation of the matrix switch bay. Moreover, it is possible to individually replace the electromotors 21. If desired, it is also feasible in a very simple and timesaving manner to exchange or replace complete switch rotors when turning the latter in an angular position in which no contacts occur by detaching the bearing cap 63 from the housing and then removing the respective switch rotor therefrom.

While the invention has been illustrated and described as embodied in an Antenna matrix switch bay, it is not intended to be limited to the details shown since various modifications and structural changes may be made without departing in any way from the spirit of the present invention.

What is claimed as new and desired to be protected by Letters Patent is set forth in the appended claims:

1. An antenna matrix switch bay, comprising:

a one-piece housing having a plurality of adjoining chambers;

a plurality of coaxial transmitter switches arranged in a first plane and a plurality of coaxial antenna switches arranged in a second plane spaced from said first plane to define a crossover matrix wherein one transmitter switch defines with one antenna switch a node, said transmitter switches and said antenna switches being jointly accommodated in said housing such that each transmitter switch and each antenna switch is housed in an individual chamber without any connecting lines from node to node;

fixed contact means cooperating with each of said antenna switches and said transmitter switches and including a pair of fixed contacts opposing each other in each of said chambers, each fixed contact of an individual chamber forming a one-piece unit with a corresponding fixed contact of an adjacent chamber;

movable contact means extending between node-defining antenna switches and transmitter switches and cooperating with said fixed contact means for selectively breaking or making a connection through said nodes; and support means for supporting fixed contacts of said transmitter switches spaced from each other in said first plane and for supporting fixed contacts of said antenna switches spaced from each other in said second plane.

2. A matrix switch bay as defined in claim 17 wherein said transmitter switches are arranged in said first plane in rows and successively connected in each row, and wherein said antenna switches are arranged in said second plane in columns coincidental to said transmitter switches and successively connected in each column.

3. A matrix switch bay as defined in claim 2 wherein said support means includes a support insulator, said fixed contacts are spaced from each other along a common axis in said first plane along said row direction being supported by such a support insulator and said fixed contacts are spaced from each other along a common axis in said second plane along said column directs being supported by such a support insulator.

4. A matrix switch bay as defined in claim 1 wherein said housing is designed in pressure-proof manner.

5. A matrix switch bay as defined in claim 1 wherein said housing is made of castable material.

6. A matrix switch bay as defined in claim 1 wherein said fixed contact means further includes a pair of opposing fixed shorting contacts conductingly connected to said housing and offset by 90° relative to said first pair of fixed contacts.

7. A matrix switch bay as defined in claim 1 wherein said movable contact means includes for each node a switch drive shaft which is oriented to extend perpendicular to said first and second planes and supports in said first plane a first straight switch member and in said second plane a second straight switch member which is turned relative to said first switch member by 90°, and a third switch member for connecting said fixed contact means in one of said planes with those in said other plane, third switch member being insulated against said first and second switch members and provided with cranked contacting ends which are offset to each other and relative to said straight first and second switch members by 90°.

8. A matrix switch bay as defined in claim 7 wherein said switch drive shaft projects with one end beyond said housing, and further comprising an electromotor attached to said housing for rotating said switch drive shaft.

9. A matrix switch bay as defined in claim 8 wherein said switch members define a radial length, and further comprising bearing means for supporting the other end of said switch drive shaft, said bearing means including a bearing cap screwed to said housing and having a diameter greater than the radial length of said switch members.

10. A matrix switch bay as defined in claim 1, and further comprising a first printed board extending within said housing for supplying current to all nodes.

11. A matrix switch bay as defined in claim 10 wherein said first printed board has one single plug connector for receiving external electric connections.

12. A matrix switch bay as defined in claim 10, and further comprising a second printed board extending parallel to said first printed board within said housing for controlling the switch states of all nodes.

13. A matrix switch bay as defined in claim 12 wherein said second printed board has one single plug connector for receiving external electric connections.

14. A matrix switch bay as defined in claim 12, and further comprising a third printed board extending parallel to said first and second printed boards within said housing for arranging a carrier safety loop over all nodes.

15. A matrix switch bay as defined in claim 14 wherein said third printed board has one single plug connector for receiving external electric connections.

* * * * *